US005182568A

United States Patent [19]

Stamps, Jr. et al.

[11] Patent Number: 5,182,568

[45] Date of Patent: Jan. 26, 1993

[54] LOSS CANCELLATION ELEMENT FOR AN INTEGRAL ANTENNA RECEIVER

[75] Inventors: Douglass K. Stamps, Jr., Boynton Beach; Lorenzo A. Ponce de Leon, Lake Worth; Jeffrey S. King, Boynton Beach, all of Fla.

[73] Assignee: Motorola, Inc., Schaumburg, Ill.

[21] Appl. No.: 525,580

[22] Filed: May 21, 1990

[51] Int. Cl.[5] ..... H01Q 1/24

[52] U.S. Cl. ..... 343/702; 343/855; 343/866

[58] Field of Search ..... 343/702, 866, 855, 728, 343/741; 455/295, 296

[56] References Cited

U.S. PATENT DOCUMENTS

| | | | |
|---|---|---|---|
| 4,491,978 | 1/1985 | Nagata et al. | 455/338 |
| 4,721,962 | 1/1988 | Gorzel | 343/702 |
| 4,814,776 | 3/1989 | Caci et al. | 343/702 |
| 4,862,181 | 8/1989 | De Leon et al. | 343/702 |
| 4,922,261 | 5/1990 | O'Farrell | 343/867 |

*Primary Examiner*—Michael C. Wimer
*Assistant Examiner*—Hoanganh Le
*Attorney, Agent, or Firm*—Philip P. Macnak; William E. Koch; Thomas G. Berry

[57] ABSTRACT

An antenna system for a communication receiver comprising a first circuit portion located on a first circuit substrate, and a second circuit portion located on a second circuit substrate comprises an antenna which is located on the first circuit substrate and at least one circuit element of the second circuit portion being positioned in proximity to the antenna to effect interaction with the antenna. A loss cancellation element comprises a conductive sheet metal element and an insulating material enclosing the conductive sheet metal element. The loss cancellation element is affixed with an adhesive to the second circuit substrate and interposed between the antenna and the interacting circuit element to reduce the interaction between the antenna and the circuit element.

13 Claims, 2 Drawing Sheets

SECTION A-A

LOSS CANCELLATION ELEMENT FOR AN INTEGRAL ANTENNA RECEIVER

BACKGROUND OF THE INVENTION

1. Field of the Invention

This invention relates generally to the field of receiving antennas for miniature communication receivers, and more particularly to an integral antenna incorporating a loss cancellation element for use in miniature communication receivers utilizing multi-board construction techniques.

2. Description of the Prior Art

Miniature communications receivers have utilized numerous antenna configurations to achieve reasonable sensitivity levels. Single-turn and multi-turn loop, antennas with and without ferrite cores have generally been utilized to provide integral antennas within the communication receiver housing. However, as the size of communication receivers, such as paging receivers, have diminished, the ability to maintain receiver sensitivities with conventional receiving antenna configurations have become more difficult, due to both general reductions in the size of the receiving antenna, and due to increased interaction of the receiving antenna with other circuit elements within the receiver. As the size of the receiver housing has decreased, the relative size of the receiving antenna had to increase to overcome at least some of the sensitivity loss due to the smaller receiver size, in particular the cross sectional area in the plane of the antenna. The relative increase in the size of the antenna has correspondingly increased the probability of interaction of the antenna with other elements of the receiver and decoder. In many cases the PC boards comprising the decoder/receiver are so densely populated that there is no room to move the elements away from the antenna area. The interaction with the antenna was especially pronounced when the antenna configuration completely enclosed the receiver and decoder electronics. As a result, the resultant receiver sensitivity was often found to be significantly less than other antenna configurations which were able to minimize the interactions by positioning the antenna apart from the circuit elements.

Various approaches have been taken to minimize or eliminate the interactions between the antenna and the receiver and decoder elements. In U.S. Pat. No. 4,862,181 to Ponce De Leon et al, entitled "Miniature Integral Antenna-Radio Apparatus", a single turn tuned floating loop was utilized to minimize the interactions. The floating loop was coupled to the receiver input using a coupler element which prevented the formation of undesired signal loss paths between the antenna and the receiver and provided impedance matching to the receiver input. U.S. Pat. No. 4,814,776, to Caci et al, entitled "Optimally Grounded Small Loop Antenna" describes an antenna configuration which completely enclosed the receiver, and described an isolation network which canceled the interaction of the antenna and the receiver by providing an optimum ground to the antenna. U.S. Pat. No. 4,491,978 to Nagata et al entitled "Portable Radio Receiver with High Antenna Gain" described an antenna configuration which substantially enclosed the receiver. The interaction of the antenna with the receiver elements was minimized by providing high impedance elements in series with at least the power supply and grounding lines at some point between the power supply and the RF-IF converter circuits. A high impedance element in series with the signal path could be optionally provided at some point downstream of the RF-IF converter circuits.

While each of the antenna configurations described above have successfully resolved problems of interaction between the antenna and the receiver and decoder elements in a receiver design having a single board configuration, significant problems still exist when the portable communication receiver configuration includes multiple boards such as shown in the sectional and planar views of FIGS. 1B through 1D, and depicted by the electrical block diagram of FIG. 1A. Referring to FIG. IA, in the multi-board configuration, the receiver components are generally located on a receiver board 10 which also includes those elements of the antenna 14. Other functions were generally located on a separate decoder board 16, which included such functions as the decoder, a display driver and display, alerting circuitry, a code plug or address and function memory, and other decoder and receiver control functions, such as battery saver controls and user operated switches. The multi-board configuration, as shown in FIG. 1A, allows multiple decoder boards, such as a decoder board for decoding the Golay Sequential Code (GSC) signaling format, or a decoder board for decoding the POCSAG signaling format, to be used with a common receiver board, such as a receiver board for the VHF, UHF or 900 MHz operating frequencies. Because of the proximity of the antenna, which is located on the receiver board 10, to any number of the components which are located on the decoder board 16, interactions which are depicted by reference numeral 12, can occur between the antenna 14 and those decoder board components in close proximity with the antenna, resulting in reduced receiver sensitivity. Significant sensitivity differences also resulted when switching from one type of decoder board to another.

Referring to FIG. IB, the interactions (shown by reference numeral 12) between the antenna 14 located on the receiver board 10 and arbitrary decoder circuit elements 18*a*, 18*b* and 18*c* are shown. For purposes of clarity, FIGS. 1B and 1D are drawn with the receiver board 10 spaced apart from the decoder board 16. In actual usage, when the receiver board and the decoder board are coupled together and positioned within the communication receiver housing, the antenna 14 of FIG. 1B would normally be in very close proximity to the decoder circuit elements, generally being separated only by an insulating spacer 22. While the decoder circuit elements identified in FIG. 1B represent physical components, such as resistors, capacitors, inductors and other electrical components, it will be appreciated that the interactions 12 can also occur due to the close proximity of the circuit traces 20*a*, 20*b* and 20*c* as shown in FIG. 1C which lie in close proximity to, or may actually traverse beneath the antenna element 14. It will be appreciated that the number of sites at which interactions 12 occur are functions of the proximity of the decoder circuit elements to the antenna element 14. The level of the interaction, and the resultant loss in sensitivity due to such interactions has been found to be a function of whether the interaction sites represent coupling from low impedance or high impedance circuits relative to the impedance of the antenna at the operating frequency of the receiver. It is desirable to maintain low impedance circuits sufficiently far from the antenna element 14, so as to minimize the interaction of the antenna with the decoder circuit elements. However, as previously stated above, as the size of the communication receivers are diminished, there becomes less flexibility in providing the optimum separation of the antenna and decoder circuit elements.

SUMMARY OF THE INVENTION

It is an object of the present invention to provide an antenna system providing improved antenna performance in a dual board communication receiver.

It is a further object of the present invention to provide an antenna system which can provide uniform antenna performance in a communication receiver utilizing a common receiver board with a plurality of optional decoder boards.

These and other objects of the invention are achieved by providing a loss cancelling element comprising a conductive sheet metal element enclosed in an insulating material which is interposed between the antenna which is located on a first circuit board and circuit elements which are located on a second circuit board. The loss cancelling element is electrically isolated from the antenna and the circuit elements on the second circuit board and provide cancellation of interactions between the antenna and circuit elements, thereby providing consistent antenna performance with different configurations of the second circuit board.

BRIEF DESCRIPTION DRAWINGS

The features of the invention which are believed to be novel are set forth with particularity in the appended claims. The invention itself, together with its further objects and advantages thereof, may be best understood by reference to the following description when taken in conjunction with the accompanying drawings, in the several figures of which like reference numerals identify identical elements, in which, and wherein:

DESCRIPTION OF THE PREFERRED EMBODIMENTS

Figure 1A:
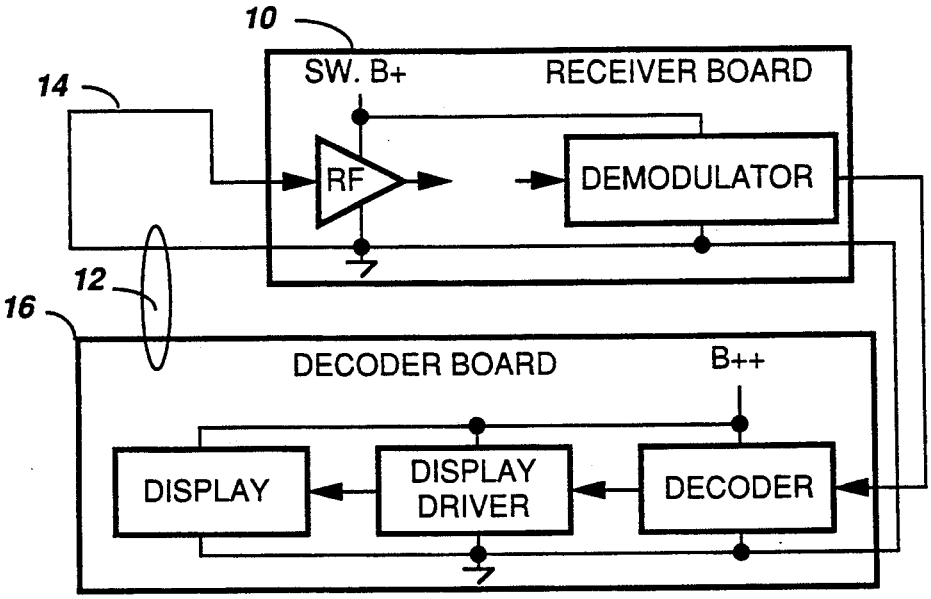
PRIOR ART FIG. 1A
FIG. 1A is and electrical block diagram of a prior art communication receiver utilizing independent receiver and decoder boards.
Figure 1B:
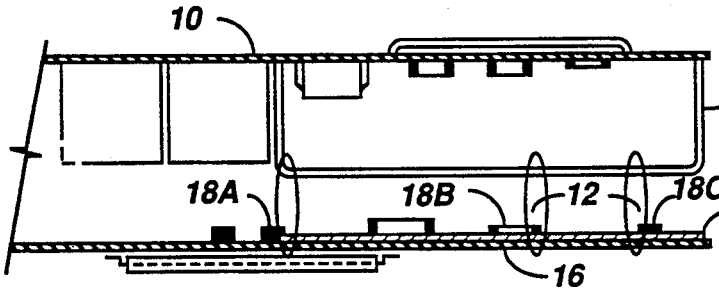
PRIOR ART FIG. 1B
FIG. 1B is a partial cross-sectional view showing the relative positioning of the receiver and decoder boards of the prior art communication receiver.
Figure 1D:
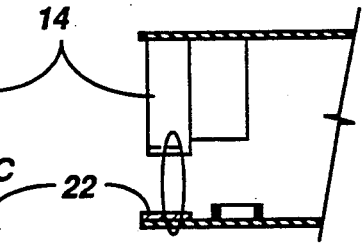
PRIOR ART FIG. 1D
FIG. 1D is a partial cross-sectional view orthogonal to the view of FIG. 1B of the prior art communication receiver.
Figure 1C:
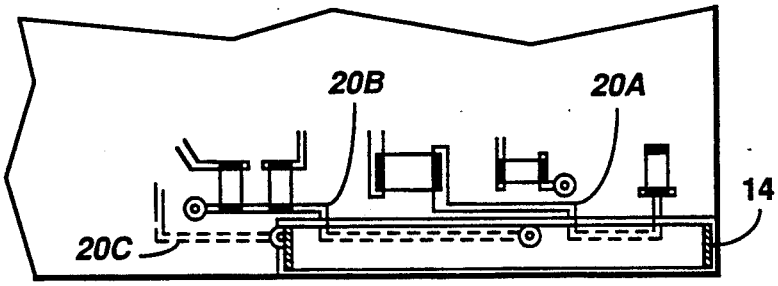
PRIOR ART FIG. 1C
FIG. 1C is a planar view of a portion of the decoder board showing the relative positioning of the antenna relative to the loss cancelling element of the prior art communication receiver.
Figure 2A:
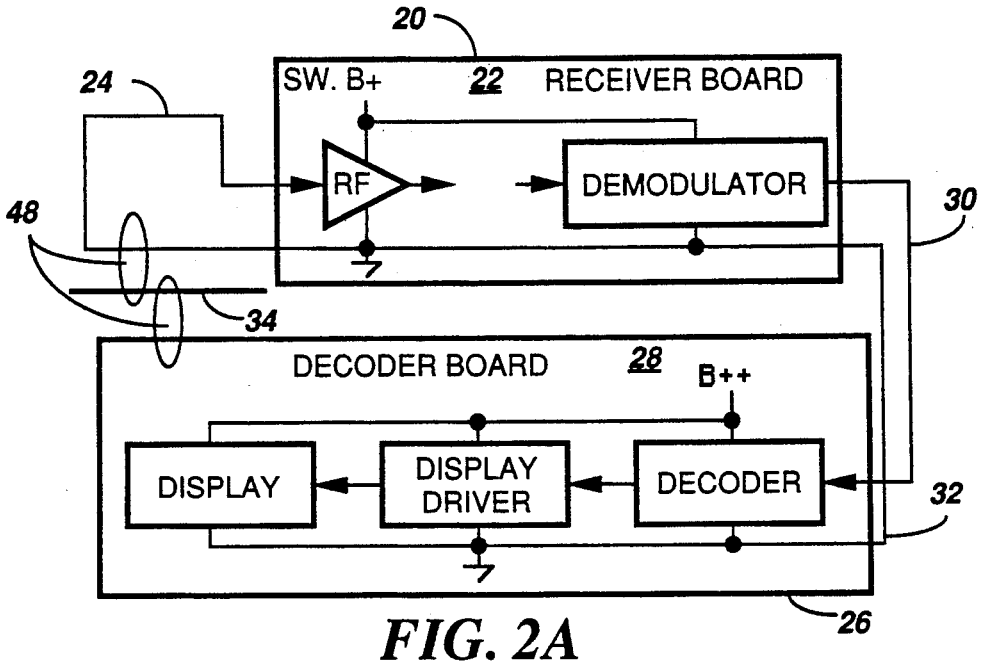
FIG. 2A is and electrical block diagram of the communication receiver utilizing the antenna system of the present invention having a loss cancelling element interposed between the independent receiver and decoder boards.

Referring to the Figures, FIGS. 2A through 2E describe the preferred embodiment of the present invention, an antenna system for a multiple board communication receiver utilizing a loss cancellation element which will be described in detail below. In the multiple board approach as shown in FIG. 2A, a first circuit substrate is provided which includes a first circuit portion, such as at least the receiver portion 22 of a communication receiver, and an antenna means 24 which is mounted to the first circuit substrate, or receiver board 20. A second circuit substrate is also provided which interconnects to the first circuit substrate and includes a second circuit portion, such as at least the decoder portion 28 of the communication receiver which is mounted to the second circuit substrate, or decoder board 26.

The operation and implementation of the receiver portion 22 is well known in the art, and will not be described in detail herein. Transmitted message signals are intercepted by the antenna means 24 and coupled to the input of the RF (radio frequency) amplifier. After being appropriately processed within the receiver portion 22, a detected message signal representative of the transmitted message signal is provided at the output of the demodulator. The receiver board 20 may also include other circuit functions, such as a data limiter for generating a digital output signal representative of the message signal received, and switching means used to control the supply of power for battery saving operation, both of which are well known in the art.

The detected message signals are coupled through a suitable interconnect for the message signal 30, and signal ground 32 to the decoder decoder board 26 where they are processed by the decoder portion 28. The operation and implementation of the decoding portion of a paging receiver are well known in the art and will not be described in detail herein. The detected message signals are processed by the decoder and message information intended for the paging receiver is presented to the user, as for example using a display, when the paging receiver is a display paging receiver.

As shown in FIG. 2A, interconnection 32 provides both a signal ground and a common supply ground between the receiver board 20 and the decoder board 26. Additional interconnections which are not shown for the sake of clarity include interconnections for a supply voltage, such as from a battery, and when appropriate interconnections for providing battery saving operation which is well known in the art. A loss cancellation means 34 is interposed between the antenna means 24 and the circuit elements of the decoder board 26, as will be described in detail below.

Figure 2B:
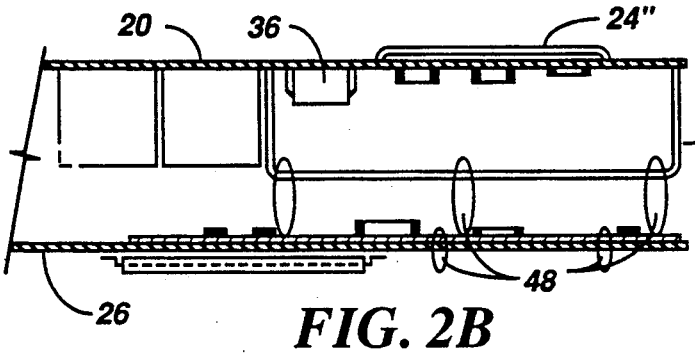
FIG. 2B is a partial cross-sectional view showing the relative positioning of the loss cancelling element of the antenna system of the present invention.

FIG. 2B is a partial cross-sectional view showing the relative positioning of the loss cancellation means of the present invention interposed between the antenna and decoder boards. The antenna means 24 in the preferred embodiment of the present invention is a single turn loop antenna formed from a U-shaped sheet metal element 24' and a second sheet metal element 24'' which couples to the input of the RF amplifier through a variable trimmer capacitor 36 which is used to tune the antenna 24. As can be seen from FIG. 2B, the long portion of the U-shaped antenna element is positioned in relatively close proximity to the circuit elements on the decoder board, when the receiver board 20 and decoder board 26 are coupled together for placement in a housing. The footprint of the U-shaped antenna element in the preferred embodiment is 0.10 inches by 1.14 inches for operation in the 929–932 MHz (megahertz) frequency range, and lie in the plane of the surface of the decoder board 26 facing the receiver board 20, and parallel to the edge of the decoder board 26.

Figure 2D:
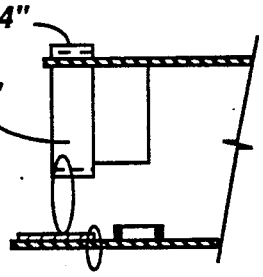
FIG. 2D is a partial cross-sectional view orthogonal to the view of FIG. 2B, showing the relative positioning of the loss cancelling element of the antenna system of the present invention.
Figure 2C:
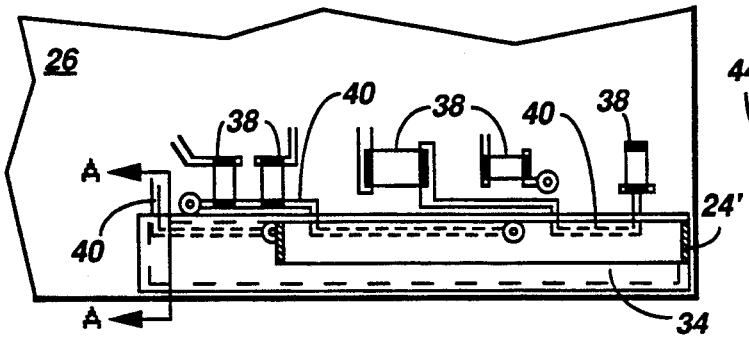
FIG. 2C is a planar view of a portion of the decoder board showing the relative positioning of the antenna relative to the loss cancelling element of the antenna system of the present invention.

FIG. 2C is a planar view of a portion of the decoder board 26 showing the relative positioning of the U-shaped antenna element 24' relative to a number of decoder circuit elements which are likely to interact with the antenna 24. The decoder circuit elements are shown for example as a number of leadless chip components 38 which are reflowed to the decoder board 26 surface facing the receiver board 20. The chip components represent for example resistors, capacitors, inductors, semiconductor devices such as transistors and packaged integrated circuits, and other electrical circuit elements. It will be appreciated other electrical and mechanical components, such as leaded components having axial and radial leads and switches and the like may also be positioned on the decoder board, depending upon the particular decoder board design and configuration.

The decoder board 26, as well as the receiver board is a circuit substrate provided for mounting the receiver and decoder components, and is manufactured using any of a number of well known materials and processes, such as a glass epoxy printed circuit board. Any of the circuit runners, or traces, 40 which are formed on the circuit substrates, can also become circuit elements which interact with the antenna, depending upon their proximity and orientation to the U-shaped antenna element 24'. As described above, any decoder circuit element or combination of elements, either a component or a circuit trace can interact with the U-shaped antenna element 24' and cause varying degrees of degradation of the antenna performance. Because the degradation is a function of the layout of the components on the decoder board, different degradations in the antenna sensitivity is obtained when different decoder boards are married to a receiver board. While "reactive impedance" coupling effects can be "tuned out" by tuning the antenna when the receiver board is coupled to the decoder board, tuning alone does not eliminate dissipative interaction of the decoder circuit elements with the antenna. Significant variations in the ultimate receiver sensitivity are, as a result, obtained for each receiver/decoder board combination.

Figure 2E:
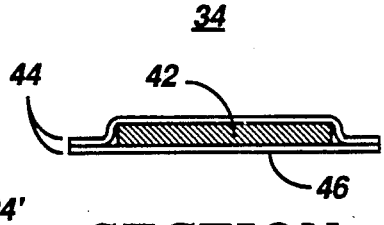
FIG. 2E is a cross-sectional view through the loss cancelling element of the antenna system of the present invention.

In the preferred embodiment of the present invention, a loss cancellation means, or element, 34 is provided which provides an improvement in the ultimate receiver sensitivity. In the 929–932 MHz frequency range, the configuration of the loss cancellation element as shown in FIG. 2B through 2D, yield an improvement of one dB (decibel), which represents a 10 percent improvement in the receiver sensitivity for a properly tuned receiver as compared to a properly tuned receiver without the loss cancellation element. The loss cancellation means 34 which is shown in a planar view in FIG. 2C, and in cross-section in FIG. 2E comprises a conductive sheet metal element enclosed in an insulating material. The conductive sheet metal element 42 is preferably formed from a highly conductive metal, such as copper, although it will be appreciated other metals having low sheet resistivity, such as beryllium copper and nickel silver may be utilized as well. The insulating material 44 enclosing the conductive sheet metal element 42 is preferably a thin mylar film laminated over the sheet metal element 42, as shown in FIG. 2E, and completely enclosing all edges of the sheet metal element. A double faced adhesive 46 (not shown) is preferably applied to one side of the enclosed sheet metal element, and provides a means of securing the loss cancellation element 34 to the decoder board. It will be appreciated where sufficient space is present between the antenna element 24' and the circuit board, the insulating material may be eliminated, and the sheet metal element can be formed to be mounted directly to the board. As shown, the overall dimensions of the loss cancellation element in the preferred embodiment of the present invention are 0.20 inches by 1.56 inches, with a rectangular sheet of 0.003 inch thick copper metal having a size of 0.16 inches by 1.50 inches. At 929 to 932 MHz, the length of the loss cancellation element is an appreciable portion of a wavelength. The loss cancellation element is not connected to any reference voltage within the receiver or decoder, but rather is electrically floating. By floating the loss cancellation element as opposed to grounding the loss cancellation element, the direct coupling, or interaction (shown by reference number 48), between the antenna and decoder circuit elements is significantly reduced, and is represented pictorially as shown in FIGS. 2B–2D. The size of the loss cancelling element has been found through empirical results to be dependant for the configuration of each particular application. Once the optimum length is determined, it will be appreciated that the lengthening, or shortening the length of the loss cancellation element will affect the resultant improvement in antenna sensitivity that is gained.

A loss cancelling element has been described above which can be interposed between a receiving antenna mounted on a first circuit board, and circuit elements which normally interact with the antenna which are mounted on a second circuit board. When the loss cancellation element is interposed between the antenna and circuit components, an improvement in the overall sensitivity of the receiver is obtained.

While specific embodiments of this invention have been shown and described, further modifications and improvements will occur to those skilled in the art. All modifications which retain the basic underlying principles disclosed and claimed herein are with the scope and spirit of the present invention.

We claim:

1. An antenna system for a communication receiver comprising a first circuit portion being located on a firs circuit substrate, and a second circuit portion being located on a second circuit substrate, said antenna system comprising:

antenna means, coupled to the first circuit portion and being located on the first circuit substrate;

at least one circuit element of said second circuit portion being positioned in proximity to said antenna means to effect an interaction therewith; and loss cancellation means, comprising a conductive sheet metal element and an insulating material enclosing said conductive sheet metal element, said loss cancellation means being affixed with an adhesive to said second circuit substrate and interposed between said antenna means and said circuit element, for cancelling the interaction therebetween.

2. The antenna system of claim 1 wherein said first circuit portion comprises at least a receiver portion for receiving and detecting transmitted message signals, and wherein said second circuit portion comprises at least a decoder portion, for decoding the detected message signals.

3. The antenna system of claim 2, wherein said receiver portion and said decoder portion are coupled with at least a common ground connection for message signal and power supply distribution.

4. The antenna system of claim 1, wherein said second circuit substrate is a printed circuit board, and wherein said at least one circuit element includes at least one printed circuit trace.

5. The antenna system according to claim 1, wherein said conductive sheet metal element is rectangular.

6. The antenna system according to claim 1, wherein said antenna means is a loop antenna.

7. The antenna system according to claim 6, wherein said loop antenna is a single turn loop.

8. A communication receiver, comprising:

a first circuit substrate, comprising antenna means, for intercepting transmitted message signals, and at least a receiver portion, coupled to said antenna means, for receiving and detecting the received message signals; and a second circuit substrate, comprising at least a decoding portion, comprising at least one of a plurality of decoder circuit elements being positioned in proximity to said antenna means to effect an interaction therewith, said decoding portion being coupled to said receiver portion, for decoding the detected messages signals, and loss cancellation means, comprising a conductive sheet metal element and an insulating material enclosing said conductive sheet meal element, said loss cancellation means being affixed with an adhesive to said second circuit substrate and interposed between said antenna means and said decoder circuit element, for cancelling the interaction therebetween.

9. The communication receiver according to claim 8, wherein said second circuit substrate is a printed circuit board, and wherein said decoder circuit elements include electrical circuit components.

10. The communication receiver according to claim 8, wherein said second circuit substrate is a printed circuit board, and wherein said decoder circuit elements include printed circuit traces.

11. The communication receiver according to claim 8, wherein said conductive sheet metal element is rectangular.

12. The communication receiver according to claim 8, wherein said antenna means is a loop antenna.

13. The communication receiver according to claim 12, wherein said loop antenna is a single turn loop.

* * * * *

UNITED STATES PATENT AND TRADEMARK OFFICE

CERTIFICATE OF CORRECTION

PATENT NO. : 5,182,568

DATED : Jan. 26, 1993

INVENTOR(S) : Stamps, Jr., et al.

It is certified that error appears in the above-identified patent and that said Letters Patent is hereby corrected as shown below:

Column 6, line 53, delete "firs" and insert --first--.

Column 8, line 9, delete "meal" and insert --metal--.

Signed and Sealed this

Eighth Day of March, 1994

*Attest:*

Bruce Lehman

BRUCE LEHMAN

*Attesting Officer*

*Commissioner of Patents and Trademarks*